US006927543B2

(12) United States Patent
Yoshinari

(10) Patent No.: US 6,927,543 B2
(45) Date of Patent: Aug. 9, 2005

(54) PLASMA DISPLAY PANEL

(75) Inventor: Masaki Yoshinari, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 21 days.

(21) Appl. No.: 10/446,120

(22) Filed: May 28, 2003

(65) Prior Publication Data

US 2003/0227426 A1 Dec. 11, 2003

(30) Foreign Application Priority Data

Jun. 7, 2002 (JP) ..... 2002-167074

(51) Int. Cl.[7] ..... G09G 3/10
(52) U.S. Cl. ..... 315/169.4; 313/581; 313/610
(58) Field of Search ..... 315/169.3, 169.4; 313/581–582, 584–586, 609–610, 292

(56) References Cited

U.S. PATENT DOCUMENTS 5,754,003 A * 5/1998 Murai et al. ..... 313/582
5,818,168 A * 10/1998 Ushifusa et al. ..... 313/582
5,909,083 A * 6/1999 Asano et al. ..... 313/584
5,939,828 A * 8/1999 Matsuzaki et al. ..... 313/584
6,195,070 B1 * 2/2001 Shinoda et al. ..... 345/60
6,344,715 B2 * 2/2002 Tokunaga et al. ..... 315/169.4
6,414,435 B1 * 7/2002 Akiba ..... 313/584
6,486,611 B2 * 11/2002 Tokunaga et al. ..... 315/169.4
6,614,412 B1 * 9/2003 Hirano et al. ..... 345/60
6,696,787 B2 * 2/2004 Akiba ..... 313/582
6,744,203 B2 * 6/2004 Jeong et al. ..... 313/587

* cited by examiner

*Primary Examiner*—Thuy Vinh Tran
(74) *Attorney, Agent, or Firm*—Arent Fox PLLC

(57) ABSTRACT

A plasma display panel has row electrode pairs regularly arranged on a front glass substrate, a plurality of column electrodes regularly arranged in a row direction on a back glass substrate and each extending in a column direction to form discharge cells at the intersections with the row electrode pairs in a discharge space, and a partition wall positioned between the front glass substrate and the back glass substrate to define the discharge cells. The partition wall is constituted of a metallic base and a dielectric insulation layer covering the metallic base. An electrode for applying a direct-current potential is connected to the metallic base of the partition wall.

15 Claims, 9 Drawing Sheets

V 1 – V 1 SECTION

V 2 – V 2 SECTION

V 1 — V 1 SECTION

V 2 — V 2 SECTION

W1 — W1 SECTION

W2 — W2 SECTION

V 3 − V 3 SECTION

V – V SECTION

W – W SECTION

PLASMA DISPLAY PANEL

BACKGROUND OF THE INVENTION

1. Field of the Invention

The invention relates to a surface-discharge-type alternating-current plasma display panel, and more particularly, to structure of a partition wall defining discharge cells of the plasma display panel.

The present application claims priority from Japanese Application No. 2002-167074, the disclosures of which are incorporated herein by reference.

2. Description of the Related Art

FIGS. 11 and 13 schematically illustrate the cell structure of a surface-discharge-type alternating-current plasma display panel (hereinafter referred to as "PDP") which has been proposed by the present applicant. FIG. 11 is a front view of the proposed PDP. FIG. 12 is a sectional view taken along the V—V line in FIG. 11, and FIG. 13 is a sectional view taken along the W—W line in FIG. 11.

The PDP in FIGS. 11 to 13 includes a front glass substrate 1 having a back surface on which a plurality of row electrode pairs (X, Y) are regularly arranged in the column direction and each extends in the row direction to form a display line L, and the row electrode pairs (X, Y) are covered by a dielectric layer 2, and then the dielectric layer 2 is covered by a protective layer 3.

The front glass substrate 1 is opposite to a back glass substrate 4 with a discharge space S in between, and on the opposing face of the back glass substrate 4, a plurality of column electrodes D are regularly arranged in the row direction and each extends in the column direction to form discharge cells C in the discharge space S at the respective intersections with the row electrode pairs (X, Y).

A partition wall 5 is shaped in a grid pattern by vertical walls 5A each extending in the column direction and transverse walls 5B each extending in the row direction. The partition wall 5 is provided between the front glass substrate 1 and the back glass substrate 4 to partition the discharge space S defined between them into the discharge cells C in the row and column directions. An additional dielectric layer 2A protrudes from a position opposite the transverse wall 5B of the partition wall 5 toward the back glass substrate 4 to come in contact with the corresponding partition wall 5 to close off the adjacent discharge cells C from each other in the column direction.

The discharge cells C have red (R)-, green (G)-, or blue (B)-colored phosphor layer 6 formed therein in turn and arranged in this order in the row direction.

For the generation of an image on the PDP, in an addressing period after completion of a reset period, an addressing discharge is selectively produced between one row electrode (the Y electrode in this example) in the row electrode pair (X, Y) and the column electrode D in each discharge cell C. As a result, the lighted cells (i.e. the discharge cells in which wall charges are generated on the dielectric layers 2) and the non-lighted cells (i.e. the discharge cells in which no wall charge is generated on the dielectric layer 2) are distributed over the panel surface.

In the sustaining discharge period after completion of the addressing discharge in the addressing period, a discharge-sustaining pulse is applied alternately to the row electrodes X and Y in the row electrode pair (X, Y) in each display line L. Thereby, a sustaining discharge is generated between the row electrodes X and Y in each lighted cell with every application of the discharge-sustaining pulse.

The sustaining discharge caused in the lighted cell generates ultraviolet light from a discharge gas sealed within the discharge space. The ultraviolet light excites the red-, green- or blue-colored phosphor layer 6 formed in the discharge cells C to emit visible light for the formation of the image to be displayed.

The partition wall 5 in the PDP has the capability of preventing the occurrence of a false discharge due to interference between discharges respectively generated in adjacent discharge cells C in the row direction and the column direction. For this reason, the partition wall 5 needs to have electrical insulation performance.

Such a partition wall 5 defining the discharge cells C of the PDP is conventionally formed by use of sand blasting techniques after the coating and burning of a low-melting glass paste, which disadvantageously increases manufacturing costs.

Hence, a measure proposed for reducing manufacturing costs while providing adequate electrical insulation performance in the partition wall 5 is that, as illustrated in FIG. 14, the inside of the partition wall 5 is formed of an electrically-conductive metallic base 5*a,* and the surface thereof is covered with a dielectric insulation layer 5*b* formed of a dielectric material having electrical insulation performance.

However, if the inside of the partition wall 5 is formed of the metallic base 5*a* in this way, as illustrated in FIG. 15, when a discharge-sustaining pulse is applied to the row electrodes X and Y in the sustaining discharge period, a potential difference is generated between the metallic base 5*a* of the partition wall 5 and the row electrode X or Y undergoing the application of the discharge-sustaining pulse (FIG. 15 illustrates the situation when the discharge-sustaining pulse is applied to the row electrode Y). This causes a part dc of the discharge current DC, which has to flow from the row electrode X to the row electrode Y, to flow toward the metallic base 5*a* of the partition wall 5 located in the proximity of the row electrode X, resulting in the problem of a decrease in the luminous efficiency caused by the sustaining discharge.

FIG. 15 also shows an electric field EF created in the discharge cell C when generating the sustaining discharge.

SUMMARY OF THE INVENTION

The present invention has been made to solve the various problems associated with the surface-discharge-type alternating-current plasma display panel having the partition wall defining the discharge cells as described above.

It is therefore an object of the present invention to provide a plasma display panel capable of improving efficiency of the light emitted by means of a sustaining discharge.

To attain the above object, a plasma display panel according to the present invention has a first feature of including: a partition wall which is positioned between a pair of opposite substrates with a discharge space in between for defining light-emitting areas in which a discharge is generated for formation of an image, and has a metallic base and a dielectric insulation layer covering the metallic base; and an electrode connected to the metallic base of the partition wall and applying a predetermined potential to the metallic base.

With the plasma display panel according to the first feature, when a discharge for generation of an image is caused in the light-emitting area defined by the partition wall positioned in the discharge space between a pair of substrates, a predetermined potential is applied to the metallic base, covered by the dielectric insulation layer constituting the partition wall, from the electrode connected to the metallic base concerned in order to reduce any potential difference between the partition wall and an electrode to which a potential is applied to cause a discharge for the generation of an image.

According to the first feature, the plasma display panel having the partition wall constituted by the metallic base covered by the dielectric insulation layer is capable of decreasing an undesired flow of the discharge current, required for generating an image, from the electrode causing the discharge toward the metallic base of the partition wall, resulting in the possibility of the enhancement of the luminous efficiency of the plasma display panel.

To attain the aforementioned object, the plasma display panel has, in addition to the configuration of the first feature, a second feature that the potential applied to the metallic base of the partition wall is a direct-current potential.

According to the second feature, the potential in the partition wall is kept constant by applying a direct-current potential to the metallic base of the partition wall.

To attain the aforementioned object, the plasma display panel has, in addition to the configuration of the first feature, a third feature that the electrode is connected to the metallic base of the partition wall in a position outside an image display area of the plasma display panel.

According to the third feature, the connection between the metallic base of the partition wall and the electrode provided for applying the potential to the metallic base is established in the position outside the image display area of the plasma display panel. Hence, there is no possibility of this connection exerting an effect upon the generation of an image within the image display area on the plasma display panel.

To attain the aforementioned object, the plasma display panel has, in addition to the configuration of the first feature, a fourth feature that the partition wall has a portion that the metallic base is not covered by the dielectric insulation layer, and the metallic base is connected to the electrode in the portion that the metallic base is not covered by the dielectric insulation layer.

According to the fourth feature, the electrode for applying the potential to the metallic base of the partition wall is formed in the portion of the partition wall in which the dielectric insulation layer is not formed.

To attain the aforementioned object, the plasma display panel has, in addition to the configuration of the fourth feature, a fifth feature that the metallic base of the partition wall and the electrode are connected to each other through a conductive paste in the portion that the metallic base is not covered by the dielectric insulation layer.

According to the fifth feature, the connection between the metallic base of the partition wall and the electrode is achieved through a conductive paste applied to the portion that the metallic base is not covered by the dielectric insulation layer. The conductive paste reliably establishes the electrically and structurally connection between the metallic base and the electrode.

To attain the aforementioned object, the plasma display panel has, in addition to the configuration of the first feature, a sixth feature that the partition wall is shaped in a grid pattern.

According to the sixth feature, the partition wall is formed in a grid pattern. Even if part of the partition wall is positioned in the proximity of an electrode provided for causing a discharge for the generation of an image, applying the potential to the metallic base of the partition wall prevents the discharge current produced for the generation of the image from undesirably flowing toward the partition wall.

To attain the aforementioned object, a plasma display panel according to the present invention includes a plurality of row electrode pairs which are regularly arranged in a column direction on one substrate of a pair of substrates, and which each extend in a row direction to form a display line; and a plurality of column electrodes which are regularly arranged in the row direction on the other substrate of the pair of substrates opposite to each other with a discharge space in between, and which each extend in the column direction to form unit light-emitting areas at intersections with the row electrode pairs in the discharge space, the plasma display panel having a seventh feature of including: a partition wall which is located between the pair of substrates to define the unit light-emitting areas, and has a metallic base and a dielectric insulation layer covering the metallic base; and an electrode connected to the metallic base of the partition wall and applying a predetermined potential to the metallic base.

With the plasma display panel according to the seventh feature, when a discharge for generating an image is caused between the row electrodes of the row electrode pair in each of the unit light-emitting areas which are respectively formed at the intersections of the row electrode pairs and the column electrodes in the discharge space between the pair of substrates, a predetermined potential is applied to the metallic base, covered with the dielectric insulation layer constituting the partition wall defining the unit light-emitting areas, from the electrode connected to the metallic base concerned in order to reduce any potential difference between the metallic base of the partition wall and the row electrode undergoing the application of a potential for the generation of an image.

According to the seventh feature, the plasma display panel having the partition wall constituted of the metallic base covered by the dielectric insulation layer is capable of decreasing an undesired flow of the discharge current, required for generating the image, from the electrode causing the discharge toward the metallic base of the partition wall, resulting in the possibility of the enhancement of the luminous efficiency of the plasma display panel.

To attain the aforementioned object, the plasma display panel has, in addition to the configuration of the seventh feature, an eighth feature that the potential applied to the metallic base of the partition wall is a direct-current potential.

According to the eighth feature, the potential in the partition wall is kept constant by applying a direct-current potential to the metallic base of the partition wall.

To attain the aforementioned object, the plasma display panel has, in addition to the configuration of the seventh feature, a ninth feature that the electrode is connected to the metallic base of the partition wall in a position outside an image display area of the plasma display panel.

According to the ninth feature, the connection between the metallic base of the partition wall and the electrode provided for applying a potential to the metallic base is established in the position outside the image display area of the plasma display panel. Hence, there is no possibility of this connection exerting an effect upon the generation of an image within the image display area on the plasma display panel.

To attain the aforementioned object, the plasma display panel has, in addition to the configuration of the seventh feature, a tenth feature that the partition wall has a portion that the metallic base is not covered by the dielectric insulation layer, and the metallic base and the electrode are connected to each other in the portion that the metallic base is not covered by the dielectric insulation layer.

According to the tenth feature, the electrode for applying the potential to the metallic base of the partition wall is formed in the portion of the partition wall in which the dielectric insulation layer is not formed.

To attain the aforementioned object, the plasma display panel has, in addition to the configuration of the tenth feature, an eleventh feature that the metallic base of the partition wall and the electrode are connected to each other through a conductive paste in the portion that the metallic base is not covered by the dielectric insulation layer.

According to the eleventh feature, the connection between the metallic base of the partition wall and the electrode is achieved through a conductive paste applied to the portion that the metallic base is not covered by the dielectric insulation layer. The conductive paste reliably establishes the electrical and structural connection between the metallic base and the electrode.

To attain the aforementioned object, the plasma display panel has, in addition to the configuration of the seventh feature, a twelfth feature that the partition wall is shaped in a grid pattern by transverse walls each extending in the row direction and vertical walls each extending in the column direction.

According to the twelfth feature, the partition wall is formed in a grid pattern. Even if the transverse wall or the vertical wall of the partition wall is positioned in the proximity of the row electrode for causing a discharge for the generation of an image, applying the potential to the metallic base of the partition wall prevents the discharge current required for generating the image from undesirably flowing toward the partition wall.

To attain the aforementioned object, the plasma display panel has, in addition to the configuration of the seventh feature, a thirteenth feature that the application of the predetermined potential to the metallic base of the partition wall is performed by either a column-electrode potential applying unit for applying a potential to the column electrode, or a row-electrode potential applying unit for applying a potential to the row electrodes of the row electrode pair.

According to the thirteenth feature, either the column-electrode potential applying unit for applying a potential to the column electrode to cause an addressing discharge between the column electrode and the row electrode in order to select the unit light-emitting areas in which light is emitted, or the row-electrode potential applying unit for alternately applying a potential to one of the pair of row electrodes constituting a row electrode pair to cause a sustaining discharge for light emission, controls the application of the potential to the metallic base of the partition wall when a sustaining discharge is produced.

To attain the aforementioned object, the plasma display panel has, in addition to the configuration of the seventh feature, a fourteenth feature that the application of the predetermined potential to the metallic base of the partition wall is performed by a partition-wall potential applying unit provided independently of a column-electrode potential applying unit for applying a potential to the column electrode, and of a row-electrode potential applying unit for applying a potential to the row electrodes of the row electrode pair.

According to the fourteenth feature, the partition-wall potential applying unit is provided independently of the column-electrode potential applying unit for applying a potential to the column electrode to cause an addressing discharge between the column electrode and the row electrode in order to select the unit light-emitting areas in which light is emitted, and of the row-electrode potential applying unit for alternately applying a potential to one of the pair of row electrodes constituting a row electrode pair to cause a sustaining discharge for light emission. When the sustaining discharge is produced between the row electrodes, the partition-wall potential applying unit controls the application of the potential to the metallic base of the partition wall.

To attain the aforementioned object, the plasma display panel has, in addition to the configuration of the seventh feature, a fifteenth feature that magnitude of the potential applied to the metallic base of the partition wall is approximately half that of a potential applied between the row electrodes of the row electrode pair to cause a discharge between the row electrodes.

According to the fifteenth feature, a potential of about half the magnitude of the potential applied to the row electrode in order to cause a discharge between the row electrodes of the row electrode pair, is applied to the metallic base of the partition wall. This causes a reduction in the potential difference between the metallic base of the partition wall and the row electrode undergoing the application of the potential, resulting in a decrease in an undesired flow of the discharge current, generated between the row electrodes for the generation of an image, from the row electrode concerned toward the metallic base of the partition wall.

These and other objects and features of the present invention will become more apparent from the following detailed description with reference to the accompanying drawings.

DETAILED DESCRIPTION OF THE PREFERRED EMBODIMENT

One of preferred embodiments according to the present invention will be described hereinafter in detail with reference to the accompanying drawings.

Figure 1:
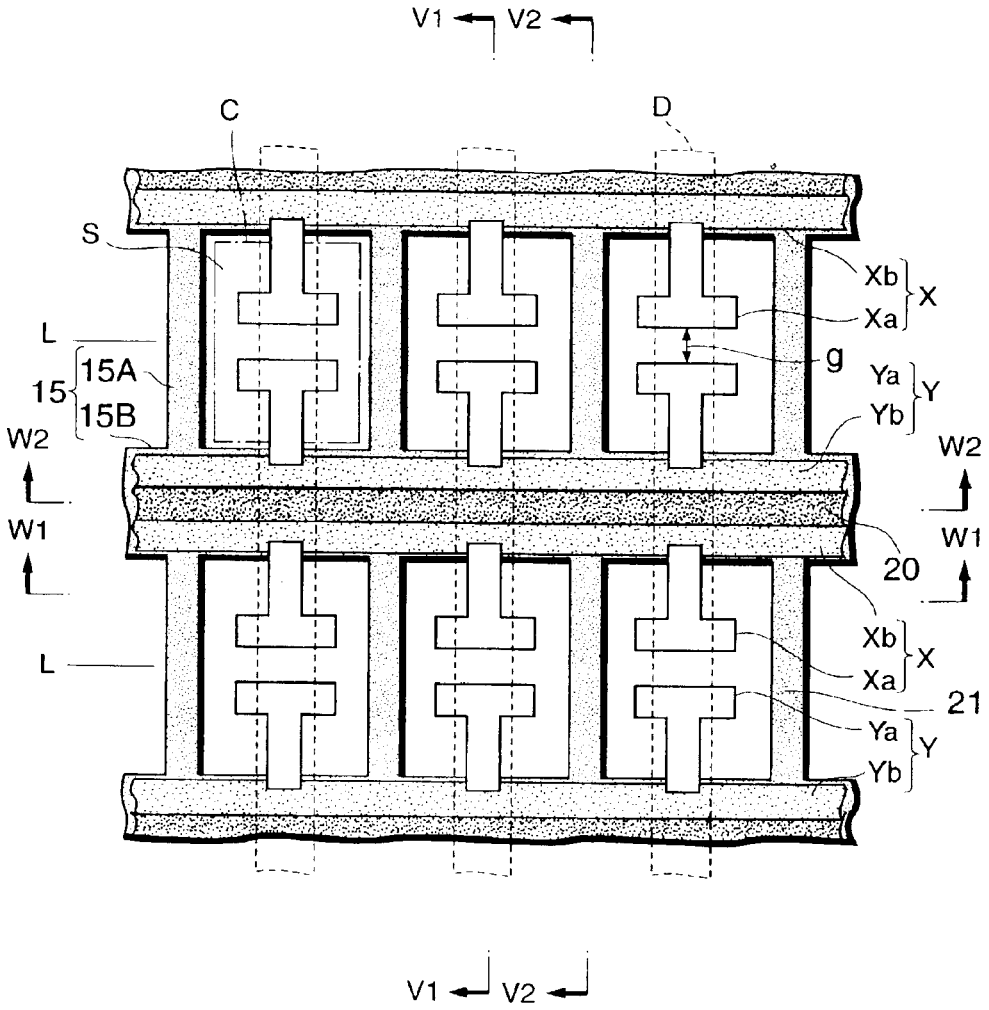
FIG. 1 is a front view illustrating an embodiment of a plasma display panel in accordance with the present invention.
Figure 2:
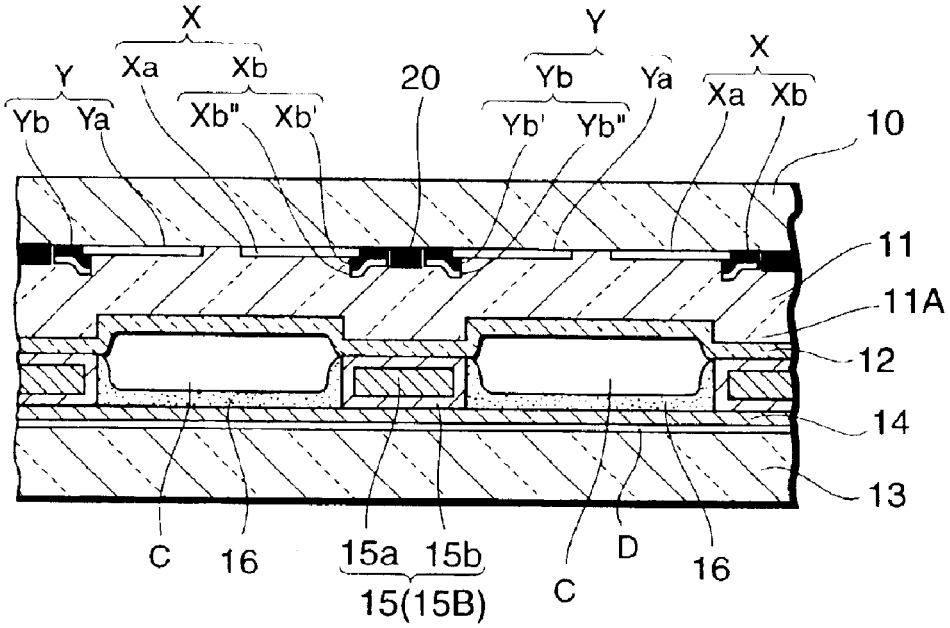
FIG. 2 is a sectional view taken along the V1—V1 line in FIG. 1.
Figure 3:
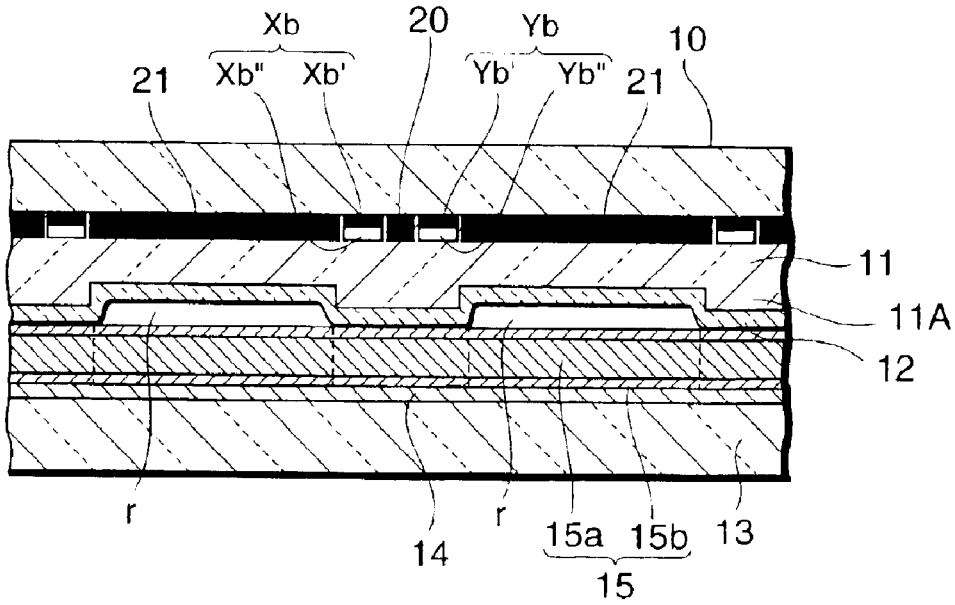
FIG. 3 is a sectional view taken along the V2—V2 line in FIG. 1.
Figure 4:
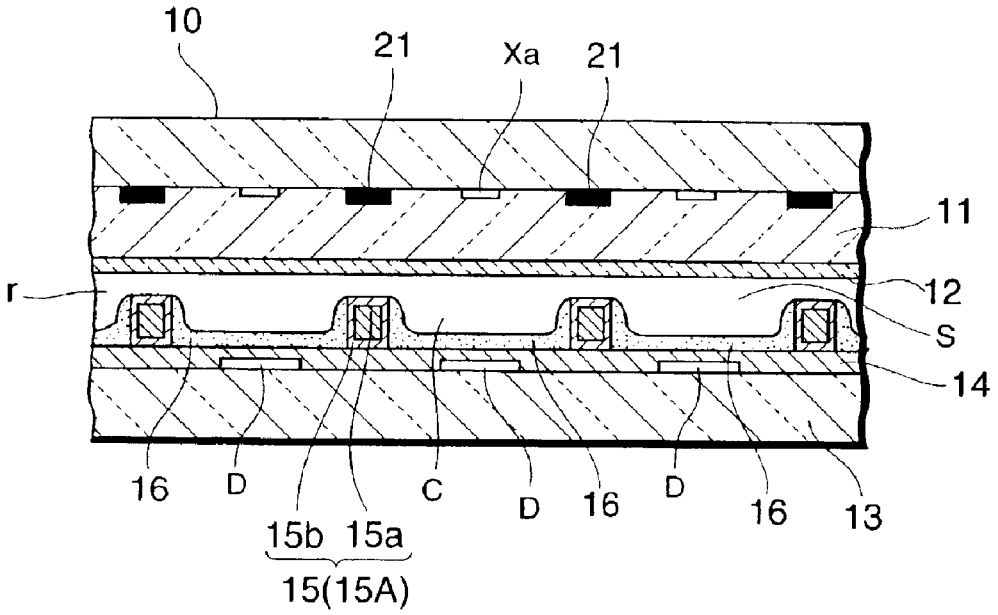
FIG. 4 is a sectional view taken along the W1—W1 line in FIG. 1.
Figure 5:
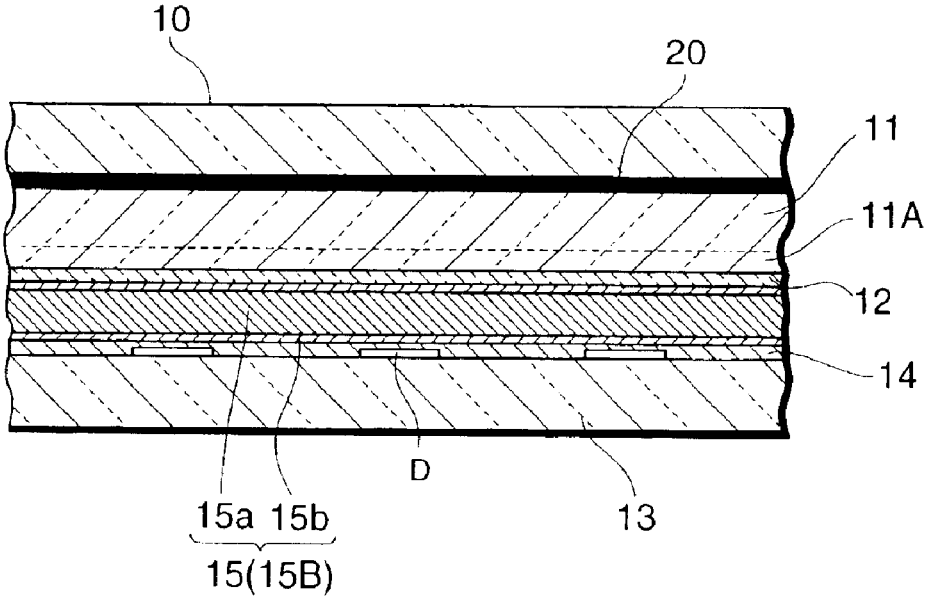
FIG. 5 is a sectional view taken along the W2—W2 line in FIG. 1.

FIG. 1 to FIG. 5 are diagrams illustrating an embodiment for a plasma display panel (hereinafter referred to as "PDP") according to the present invention. FIG. 1 is a schematic front view illustrating the relation between a row electrode pair and a partition wall of the PDP in the embodiment. FIG. 2 is a sectional view taken along the V1—V1 line of FIG. 1, and similarly FIG. 3 is a sectional view taken along the V2—V2 line, FIG. 4 is a sectional view taken along the W1—W1 line, and FIG. 5 is a sectional view taken along the W2—W2 line.

Referring to FIGS. 1 to 5, a front glass substrate 10 serving as a display screen has a back surface on which a plurality of row electrode pairs (X, Y) are arranged in parallel so as to extend in a row direction (the right-left direction in FIG. 1) of the front glass substrate 10.

The row electrode X is constituted of transparent electrodes Xa which are each formed of a T-shaped transparent conductive film made of ITO or the like, and a bus electrode Xb formed of a metal film which extends in the row direction of the front glass substrate 10, and is connected to a narrowed proximal end (i.e. the foot of the T shape) of each transparent electrode Xa.

Likewise, the row electrode Y is constituted of transparent electrodes Ya which are each formed of a T-shaped transparent conductive film made of ITO or the like, and a bus electrode Yb formed of a metal film which extends in the row direction of the front glass substrate 10, and is connected to a narrowed proximal end (i.e. the foot of the T shape) of each transparent electrode Ya.

The row electrodes X and Y are regularly arranged in alternate positions in a column direction (the vertical direction in FIG. 1) of the front glass substrate 10. The transparent electrodes Xa and Ya regularly arranged along the corresponding bus electrodes Xb and Yb in each row electrode pair (X, Y) extend toward each other so that the tops of the widened distal ends (i.e. the head of the T shape) of the transparent electrodes Xa and Ya are opposite each other with a discharge gap g set at a required distance in between.

Each of the bus electrodes Xb and Yb is formed in a double layer structure constituted of a black conductive layer Xb' (Yb') positioned on the display screen side and a main conductive layer Xb" (Yb") facing backward.

On the back surface of the front glass substrate 10, a black light absorption layer (light-shield layer) 20 extends in the row direction along and between the back-to-back bus electrodes Xb and Yb of the respective row electrode pairs (X, Y) adjacent to each other in the column direction. Further, another black light absorption layer (light-shield layer) 21 extends between the bus electrodes Xb and Yb of each row electrode pair (X, Y) in the column direction and in a midpoint position between the pairs of opposing transparent electrodes Xa and transparent electrodes Ya in the row direction.

The light absorption layer 20 is opposite to a transverse wall of a partition wall described later, and the light absorption layer 21 is opposite to a vertical wall of the partition wall.

On the back surface of the front glass substrate 10, a dielectric layer 11 covers the row electrode pairs (X, Y), and has a back surface from which additional dielectric layers 11A protrude backward. The additional dielectric layer 11A extends in parallel to the bus electrodes Xb and Yb in a position opposite the adjacent bus electrodes Xb and Yb of the respective and adjacent row electrode pairs (X, Y) and also opposite the area between the adjacent bus electrodes Xb and Yb concerned.

An MgO-made protective layer 12 is formed on the back surfaces of the dielectric layer 11 and the additional dielectric layer 11A.

In turn, a back glass substrate 13 placed in parallel to the front glass substrate 10 has a surface, facing toward the display screen, on which column electrodes D are arranged in parallel to each other at predetermined intervals so that each extends in a direction at right angles to the row electrode pairs (X, Y) (i.e. in the column direction) in a position opposite the paired transparent electrodes Xa and Ya of each row electrode pair (X, Y).

On the surface of the back glass substrate 13 opposite to the front glass substrate 10, the column electrodes D are covered by a column-electrode protective layer (dielectric layer) 14 on which a grid-patterned partition wall 15 is formed. The partition wall 15 has vertical walls 15A each extending in the column direction between adjacent column electrodes D arranged in parallel, and transverse walls 15B each extending in the row direction in a position opposite the additional dielectric layer 11A.

The partition wall 15 is constituted of a grid-patterned conductive metallic base 15*a* covered by a dielectric insulation layer 15*b* which is formed of a dielectric material having electrical insulation performance.

The grid-patterned partition wall 15 partitions the discharge space S between the front glass substrate 10 and the back glass substrate 13 into areas, each opposing to the paired transparent electrodes Xa and Ya in each row electrode pair (X, Y), to form quadrangular discharge cells C, respectively.

The face of the vertical wall 15A of the partition wall 15 facing toward the display screen is out of contact with the protective layer 12 (see FIG. 4) to form a clearance r between them. The face of the transverse wall 15B facing toward the display screen is in contact with a part of the protective layer 12 covering the additional dielectric layer 11A to block adjacent discharge cells C from each other in the column direction (see FIGS. 2 and 5).

Inside each discharge cell C, a phosphor layer 16 is formed on the side faces of the vertical walls 15A and the transverse walls 15B of the partition wall 15 and the face of the column-electrode protective layer 14 so as to cover all of the five faces. One of the primary colors red (R), green (G), and blue (B) is applied in turn to the phosphor layer 16 in each discharge cell C so that the three primary colors are arranged in order in the row direction.

The discharge space S between the front glass substrate 10 and the back glass substrate 13 is filled with a discharge gas.

Figure 6:
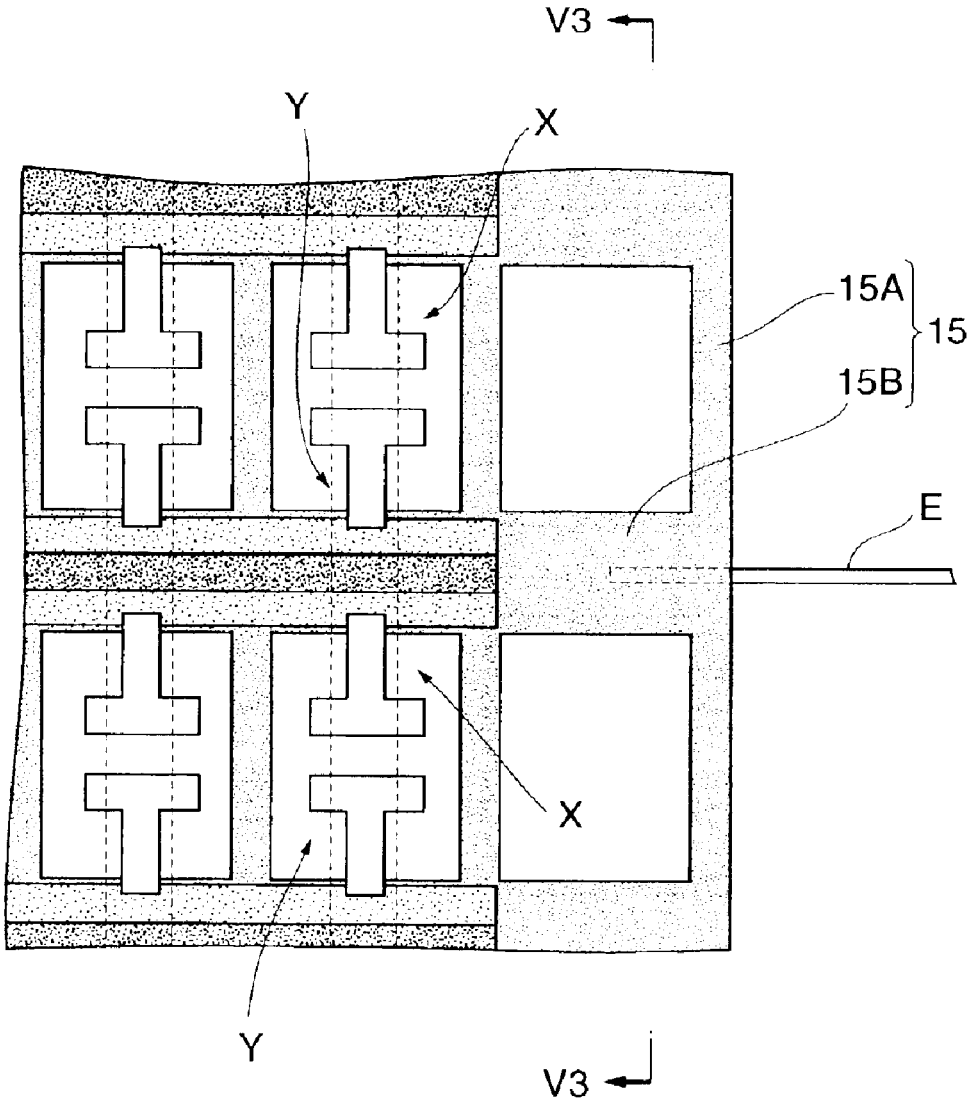
FIG. 6 is a front view illustrating the configuration of part of the area outside the image display area of the plasma display panel in the embodiment.
Figure 7:
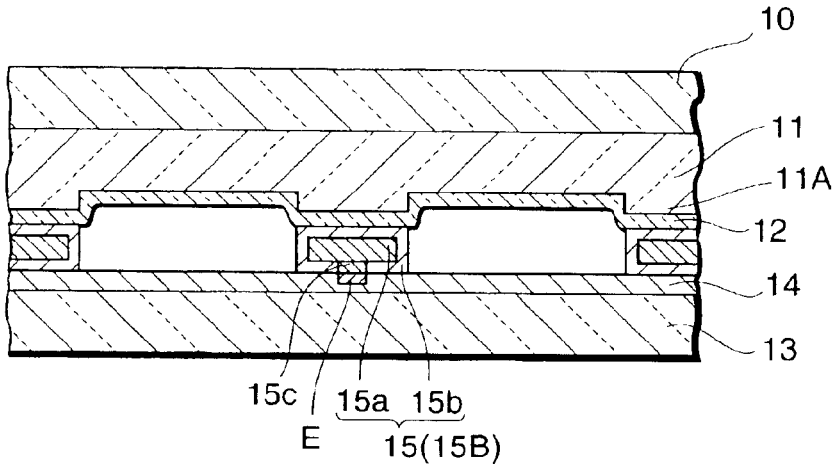
FIG. 7 is a sectional view taken along the V3—V3 line in FIG. 6.

FIG. 6 is a plan view partially illustrating the non-display area of the margin portion of the PDP configured as described above. FIG. 7 is a sectional view taken along the V3—V3 line in FIG. 6.

In the non-display area of the PDP in FIGS. 6 and 7, a leading electrode E is provided between the backward face of the transverse wall 15B of the partition wall 15 and the column-electrode protective layer 14.

The dielectric insulation layer 15*b* covering the metallic base 15*a* is not formed on the portion of the partition wall 15 opposite to the leading electrode E. In this portion, the metallic base 15*a* and the leading electrode E are electrically connected to each other through a conductive paste 15*c* applied to between the metallic base 15*a* and the leading electrode E.

The row electrode pair (X, Y) form a display line L on the matrix display screen of the PDP.

Figure 8:
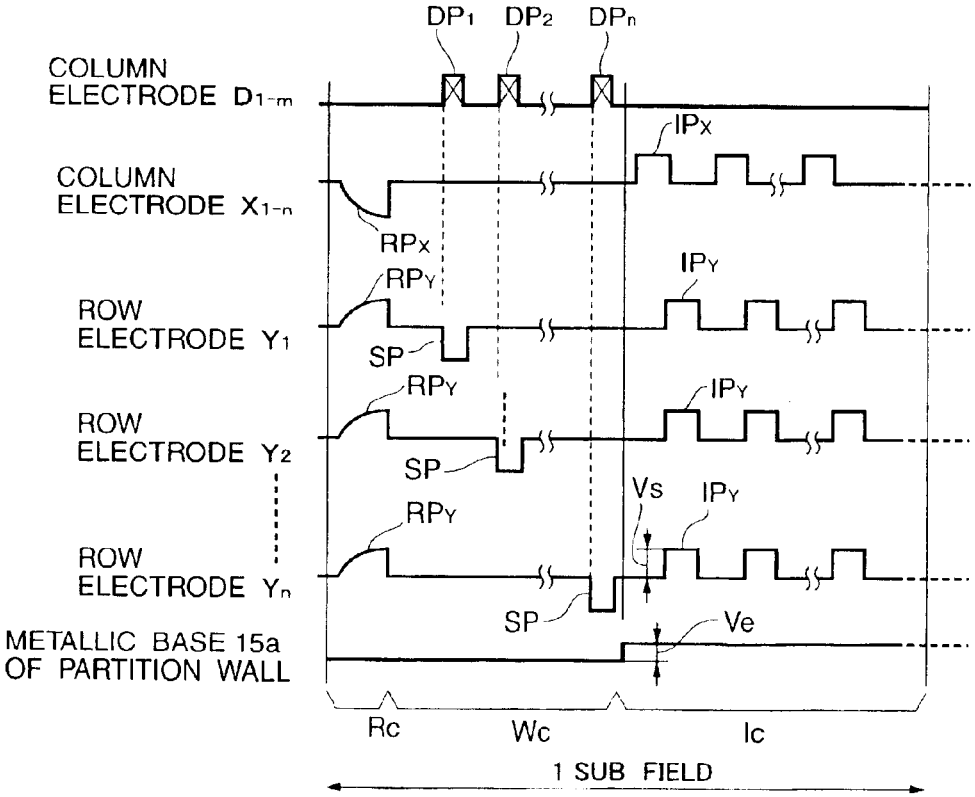
FIG. 8 is a time chart showing the timing of the application of an electric potential to a partition wall in the embodiment.

FIG. 8 is a time chart of the application of a pulse when the PDP is operated for generating an image.

Next, a description is given of the operation when the PDP is operated for generating an image with reference to the time chart in FIG. 8.

After completion of a reset period Rc in which reset pulses RPx and RPy are applied to the row electrodes X and Y for a reset discharge, in an addressing period Wc in which an addressing discharge is triggered by the application of a data pulse DPn to the column electrode D and the application of an operation pulse SP to the row electrode Y, the lighted cells (the discharge cells C in which wall charges are generated on the dielectric layer 11) and the non-lighted cells (the discharge cells C in which no wall charge is generated on the dielectric layer 11) are distributed over the panel surface in accordance with an image to be displayed.

Then, in a sustaining discharge period Ic subsequent to the completion of the addressing period, simultaneously in all the display lines L, discharge-sustaining pulses IPx and IPy are alternately applied to each row electrode pair (X, Y) to generate an emission-sustaining discharge in a discharge gap between the transparent electrodes Xa and Ya in each row electrode pair (X, Y) in the lighted cell. Ultraviolet light generated from the discharge gas by the emission-sustaining discharge excites each of the phosphor layers 16 of the three primary colors red (R), green (G) and blue (B) to emit light for the formation of the image to be displayed.

In the sustaining discharge period Ic, a predetermined direct-current potential Ve is applied from the leading electrode E to the metallic base 15*a* via the conductive paste 15*c* of the partition wall 15.

Figure 9:
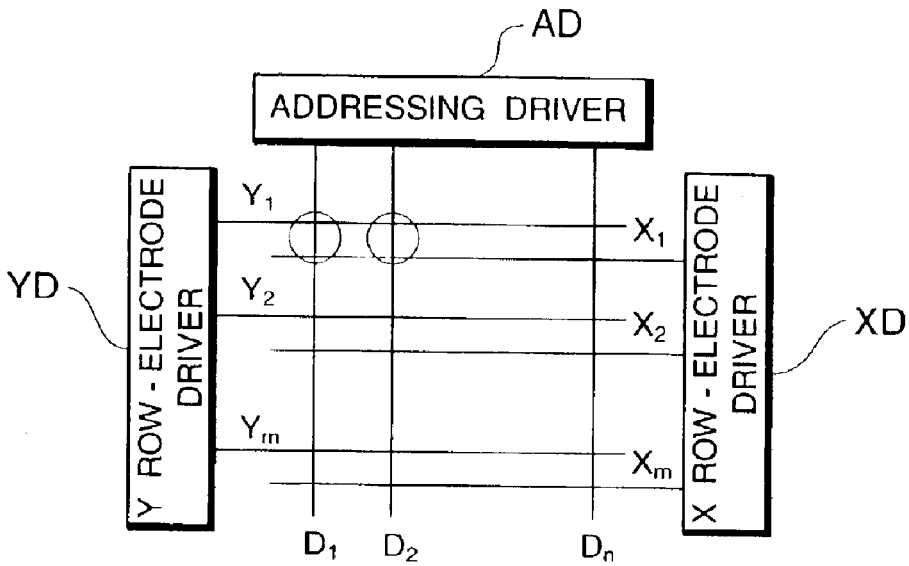
FIG. 9 is a block diagram illustrating the configuration of drivers for applying the potentials in the embodiment.

The embodiment sets the direct-current potential Ve at a value approximately half the voltage Vs of the discharge-sustaining pulse IPx or IPy, namely approximately half the potential difference between the row electrodes X and Y on the application of the discharge-sustaining pulse IPx or Ipy. For example, the application of the direct-current potential Ve from the leading electrode E to the metallic base 15*a* of the partition wall 15 is controlled by any one of row-electrode drivers XD and YD providing the application of the discharge-sustaining pulse to the row electrodes X and Y, or an addressing driver AD providing the application of a data pulse to the column electrode D which are illustrated in FIG. 9. Alternatively, the direct-current potential Ve is applied by a driver (not shown) specifically provided.

In this manner, when the emission-sustaining discharge is generated in the sustaining discharge period Ic, a direct-current potential Ve is applied to the metallic base 15*a* of the partition wall 15, to reduce the potential difference between the partition wall 15 and each of the row electrodes X and Y which respectively undergo the application of the discharge-sustaining pulses IPx and IPy.

Figure 10:
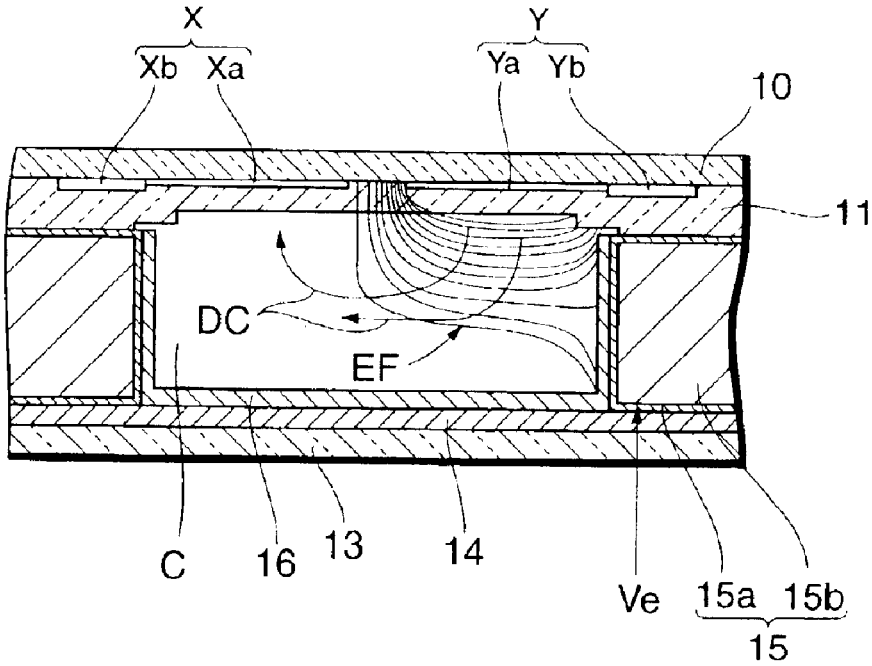
FIG. 10 is a diagram illustrating the state of a discharge current when generating a sustaining discharge in the embodiment.
Figure 11:
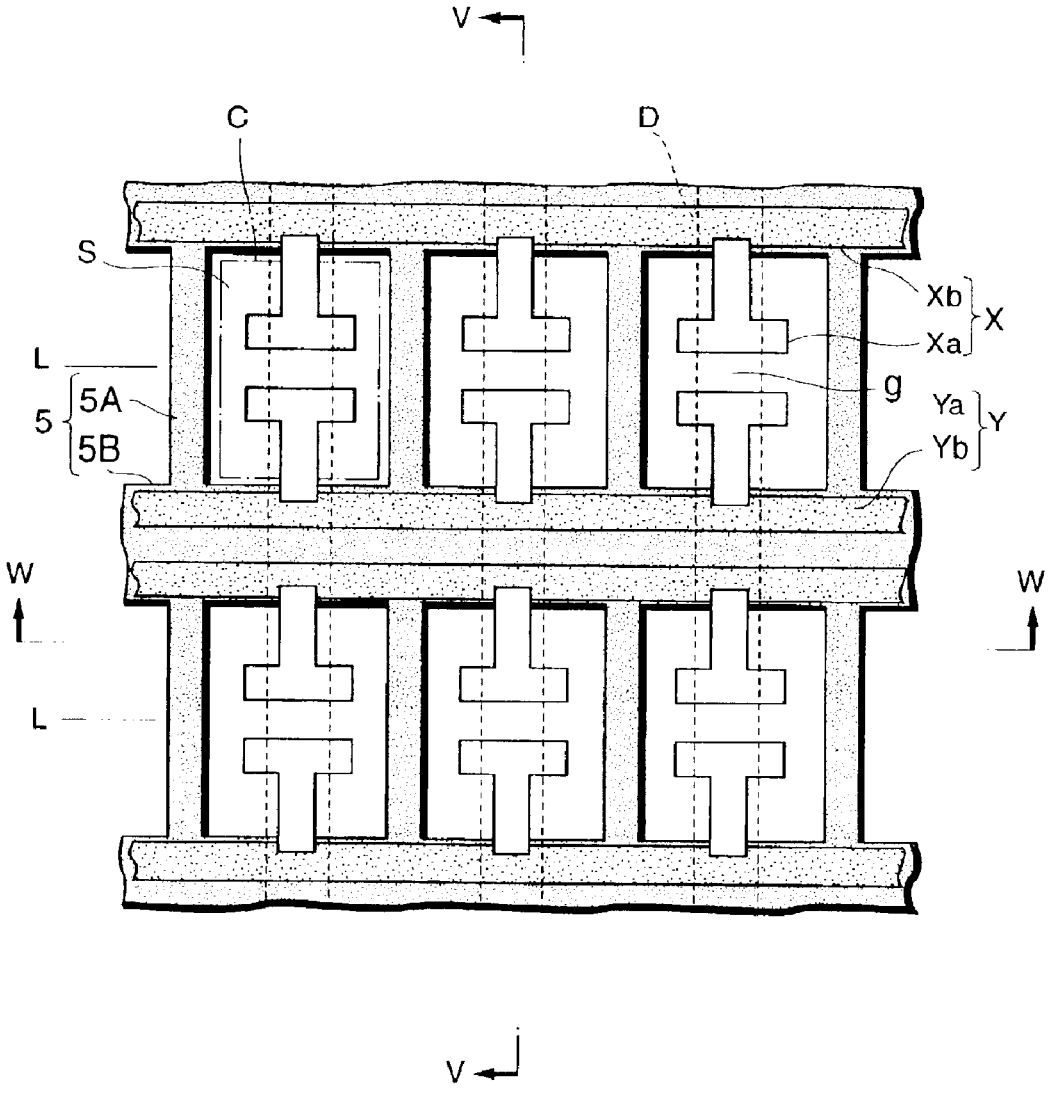
Fig.11 PRIOR ART
FIG. 11 is a front view illustrating a conventional cell structure of a plasma display panel.
Figure 12:
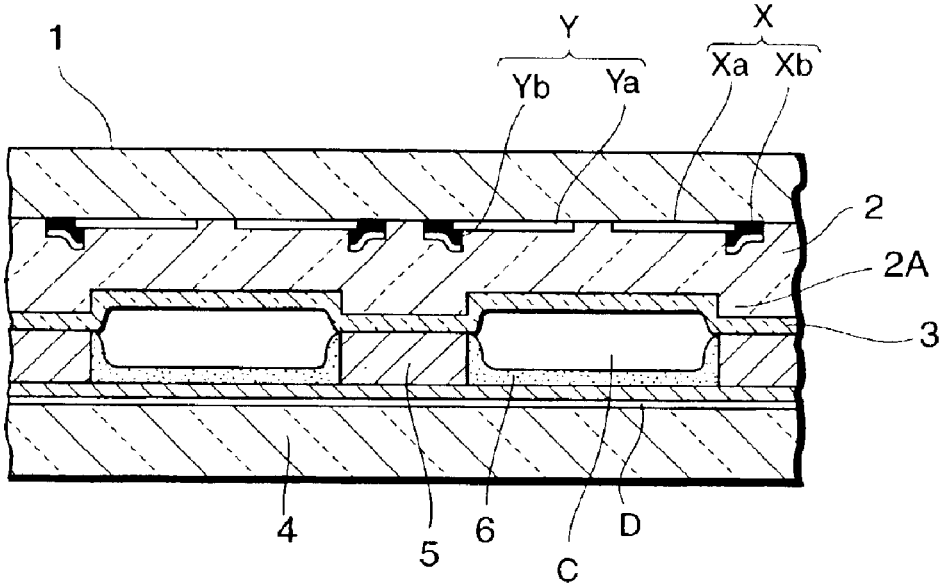
Fig. 12 PRIOR ART
FIG. 12 is a sectional view taken along the V—V line in FIG. 11.
Figure 13:
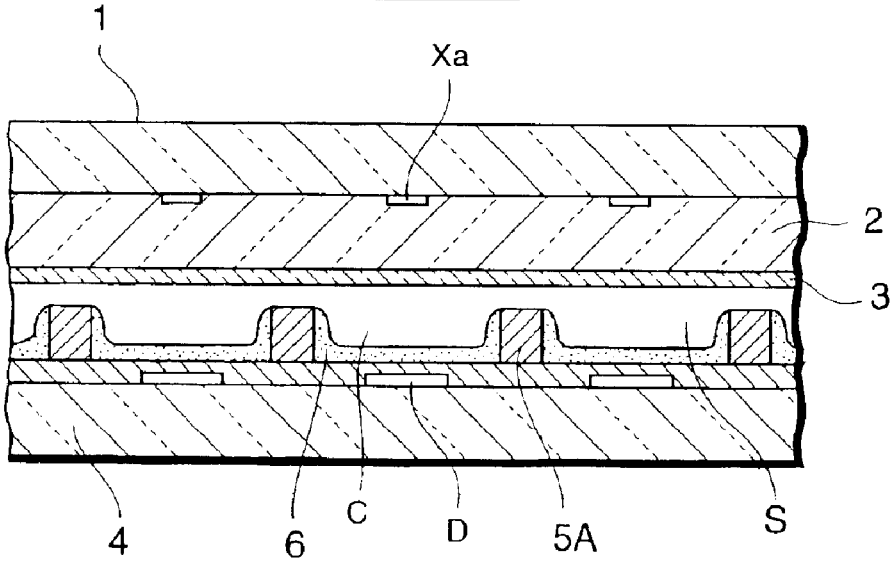
Fig. 13 PRIOR ART
FIG. 13 is a sectional view taken along the W—W line in FIG. 11.
Figure 14:
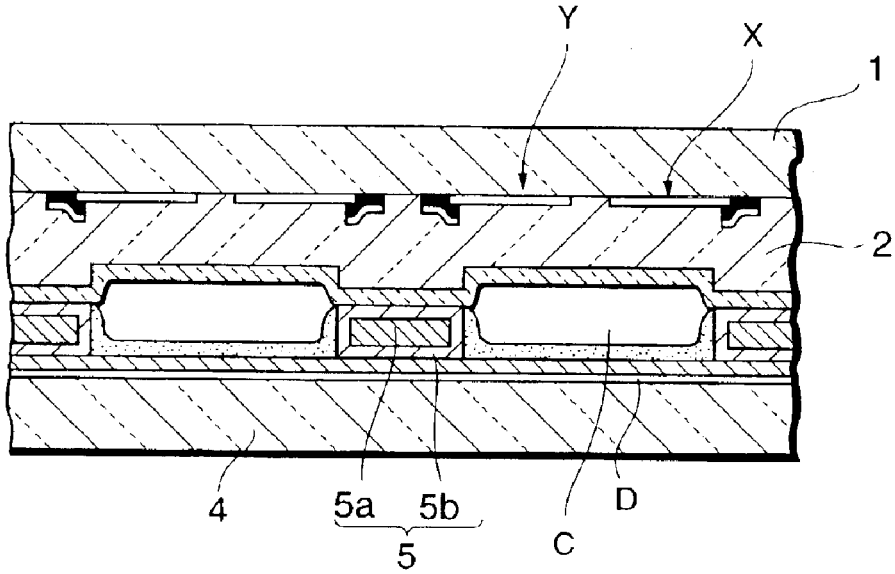
Fig. 14 PRIOR ART
FIG. 14 is a sectional view illustrating another example of a conventional plasma display panel.
Figure 15:
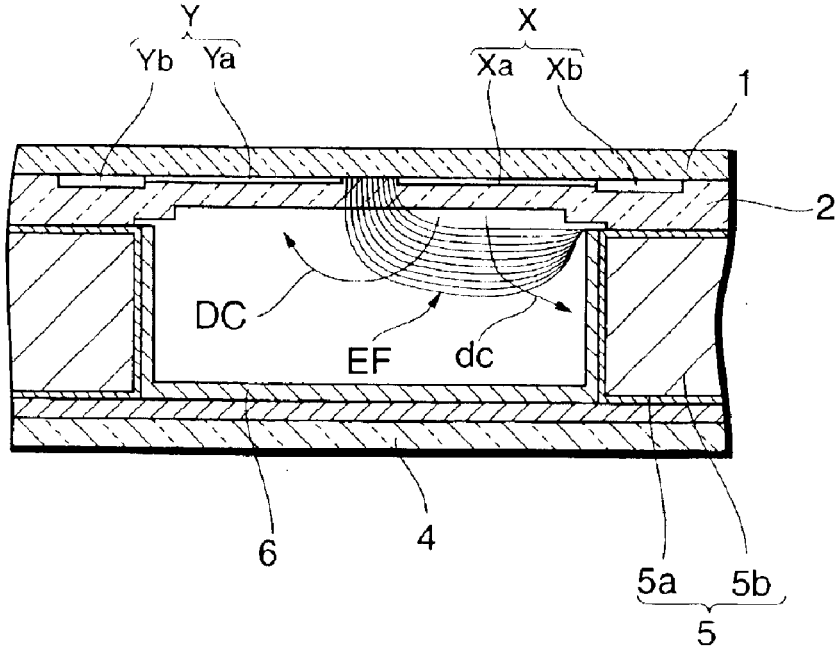
Fig. 15 PRIOR ART
FIG. 15 is a diagram illustrating the state of a discharge current when generating a sustaining discharge in the plasma display panel in FIG. 14.

Thus, as illustrated in FIG. 10, an electric field EF is created by the row electrode subjected to the application of the discharge-sustaining pulse (the row electrode Y in FIG. 10) and a portion of the partition wall 15 positioned close to the row electrode Y. Due to the generation of the electric field EF, most of the discharge current DC from the row electrode Y flows toward the row electrode X to which the discharge-sustaining pulse is not applied at this moment to decrease the flow of the discharge current toward the partition wall 15. As a result, the event of the luminous efficiency being reduced by an undesired flow of the discharge current toward the partition wall 15 is prevented.

In the foregoing embodiment, the setting of the voltage applied to the metallic base 15*a* at approximately half the voltage Vs of the discharge-sustaining pulse IPx or IPy is aimed at reducing any potential difference created between the row electrode X and the metallic base 15*a* and any potential difference created between the row electrode Y and the metallic base 15a when the discharge-sustaining pulses IPx and IPy are applied thereto, respectively.

Specifically, for example, if a voltage of Vs/3 is applied to the metallic base 15*a,* then a small potential difference of Vs/3 is produced between the row electrode Y and the metallic base 15*a,* whereas a large potential difference of 2 Vs/3 is produced between the row electrode X and the metallic base 15*a*. However, when a pulse of a voltage Vs is applied to the row electrode X and the potential of the row electrode Y is zero volt, if a voltage of Vs/2 is applied to the metallic base 15*a,* the potential difference between the row electrode X and the metallic base 15*a* and the potential difference between the row electrode Y and the metallic base 15*a* each becomes Vs/2, resulting in a reduction in the potential difference between the metallic base 15*a* and each of the row electrodes X and Y.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, comprising:

a partition wall positioned between a pair of opposite substrates with a discharge space in between for defining light-emitting areas in which a discharge is generated for formation of an image, and having a metallic base and a dielectric insulation layer covering the metallic base; and an electrode connected to the metallic base of the partition wall and applying a predetermined potential to the metallic base, wherein said partition wall has a portion that the metallic base is not covered by the dielectric insulation layer, and said metallic base and said electrode are connected to each other in the portion that the metallic base is not covered by the dielectric insulation layer.

2. A plasma display panel according to claim 1, wherein the potential applied to the metallic base of said partition wall is a direct-current potential.

3. A plasma display panel according to claim 1, wherein said electrode is connected to the metallic base of said partition wall in a position outside an image display area of the plasma display panel.

4. A plasma display panel according to claim 1, wherein said metallic base of the partition wall and said electrode are connected to each other through a conductive paste in the portion that the metallic base is not covered by the dielectric insulation layer.

5. A plasma display panel according to claim 1, wherein said partition wall is shaped in a grid pattern.

6. A plasma display panel including a plurality of row electrodes regularly arranged in a column direction on one substrate of a pair of substrates and each extending in a row direction to form a display line, and a plurality of column electrodes regularly arranged in the row direction on the other substrate of the pair of substrates opposite to each other with a discharge space in between, and each extending in the column direction to form unit light-emitting areas at intersections with the row electrode pairs in the discharge space, said plasma display panel comprising:

a partition wall positioned between the pair of substrates to define the unit light-emitting areas, and having a metallic base and a dielectric insulation layer covering the metallic base; and an electrode connected to the metallic base of the partition wall and applying a predetermined potential to the metallic base, wherein said partition wall has a portion that the metallic base is not covered by the dielectric insulation layer, and said metallic base and said electrode are connected to each other in the portion that the metallic base is not covered by the dielectric insulation layer.

7. A plasma display panel according to claim 6, wherein the potential applied to the metallic base of said partition wall is a direct-current potential.

8. A plasma display panel according to claim 6, wherein said electrode is connected to the metallic base of said partition wall in a position outside an image display area of the plasma display panel.

9. A plasma display panel according to claim 6, wherein said metallic base of the partition wall and said electrode are connected to each other through a conductive paste in the portion that the metallic base is not covered by the dielectric insulation layer.

10. A plasma display panel according to claim 6, wherein said partition wall is shaped in a grid pattern by transverse walls each extending in the row direction and vertical walls each extending the column direction.

11. A plasma display panel according to claim 6, wherein the application of the predetermined potential to said metallic base of the partition wall is performed by either a column-electrode potential applying unit for applying a potential to the column electrode, or a row-electrode potential applying unit for applying a potential to the row electrodes of the row electrode pair.

12. A plasma display panel according to claim 6, wherein the application of the predetermined potential to said metallic base of the partition wall is performed by a partition-wall potential applying unit provided independently of a column-electrode potential applying unit for applying a potential to the column electrode, and of a row-electrode potential applying unit for applying a potential to the row electrodes of the row electrode pair.

13. A plasma display panel according to claim 6, wherein magnitude of the potential applied to said metallic base of the partition wall is approximately half a potential applied between the row electrodes of the row electrode pair to cause a discharge between the row electrodes.

14. A plasma display panel, comprising:

a partition wall positioned between a pair of opposite substrates with a discharge space in between for defining light-emitting areas in which a discharge is generated for formation of an image, and having a metallic base and a dielectric insulation layer covering the metallic base; and an electrode connected to the metallic base of the partition wall and applying a predetermined potential to the metallic base, wherein a magnitude of the potential applied to said metallic base of the partition wall is approximately half potential applied between the row electrodes of the row electrode pair to cause a discharge between the row electrodes.

15. A plasma display panel including a plurality of row electrodes regularly arranged in a column direction on one substrate of a pair of substrates and each extending in a row direction to form a display line, and a plurality of column electrodes regularly arranged in the row direction on the other substrate of the pair of substrates opposite to each other with a discharge space in between, and each extending in the column direction to form unit light-emitting areas at intersections with the row electrode pairs in the discharge space, said plasma display panel comprising:

a partition wall positioned between the pair of substrates to define the unit light-emitting areas, and having a metallic base and a dielectric insulation layer covering the metallic base; and an electrode connected to the metallic base of the partition wall and applying a predetermined potential to the metallic base, wherein a magnitude of the potential applied to said metallic base of the partition wall is approximately half a potential applied between the row electrodes of the row electrode pair to cause a discharge between the row electrodes.

* * * * *